United States Patent [19]

Prouty et al.

[11] 3,952,902

[45] Apr. 27, 1976

[54] CLOSURE CAP FOR PLASMA RECEIVING ASSEMBLY

[75] Inventors: Myron R. Prouty, Oakland; Robert D. Tuseth, Alameda, both of Calif.

[73] Assignee: Cutter Laboratories, Inc., Berkeley, Calif.

[22] Filed: Apr. 26, 1974

[21] Appl. No.: 464,463

[52] U.S. Cl. ..... 215/306; 215/308; 215/309

[51] Int. Cl.[2] ..... B65D 51/16

[58] Field of Search ..... 215/261, 306, 307, 308, 215/309; 222/484; 220/360

[56] References Cited

UNITED STATES PATENTS

| | | | |
|---|---|---|---|
| 3,059,816 | 10/1962 | Goldstein | 215/309 X |
| 3,655,102 | 4/1972 | Moran | 222/484 |

*Primary Examiner*—Donald F. Norton

*Attorney, Agent, or Firm*—Gardiner, Sixbey, Bradford & Carlson

[57] ABSTRACT

Method and apparatus is disclosed relating to the use of a plasma receiving assembly including a container and closure cap adapted to permit aseptic handling, storage and shipment of blood plasma. One aspect of the method is to form the plasma receiving assembly by placing a plasma receiving container within an overwrap having a gas permeable bacterial filter such that the container and overwrap may be gas sterilized followed by mechanical sealing of the container while still in the overwrap. The method further provides for use of the overwrap to lessen the chances of contamination during handling and transfer of the blood plasma including the steps of forming the container in a rigid standardized cylindrical form and limiting the volume of plasma placed in each container so that the plasma may be frozen and removed automatically. The method is facilitated by a novel closure cap having a cover adapted for axial movement between a partially open position in which sterilized gas may pass into and out of the container and a fully closed position in which the container is hermetically sealed for shipment. Because the closure cap cover may be operated by direct pressure applied to the upper surface, operation of the closure cap cover when the container is within the overwrap is greatly facilitated.

17 Claims, 10 Drawing Figures

CLOSURE CAP FOR PLASMA RECEIVING ASSEMBLY

BACKGROUND OF THE INVENTION a. Field of the Invention

This invention relates to a closure cap for a container and a method for using the closure cap and container to allow aseptic collection and processing of blood plasma.

b. Background of the Invention

Blood plasma is conventionally collected in a container, such as disclosed in U.S. Pat. No. 3,545,671, which is adapted to receive whole blood directly from a donor and to permit immediate fractionation of the blood into component parts. Following separation, the blood plasma is expressed into a flexible polyvinyl chloride shipping container which may then be placed in a freezing bath to freeze the plasma so as to protect it from deterioration until it can be processed. When the shipping container is received at a central processing plant, it is slit open with a knife to allow the plug of frozen plasma to drop into a vat. After many such plugs have been collected in the vat, processing begins.

There are several problems associated with a system of this type. The major problem is one of bacterial contamination of the plasma at the time the bag is cut with a knife and the blade comes in contact with plasma. Since the same knife is used repeatedly, it can become contaminated by bacteria in the environment. In addition, although the interior of the bag is sterile, the outside is not and may have become contaminated at any stage from the time plasma was introduced into it, during shipping, or at any other time prior to its being cut open. As the frozen plug of plasma slips from the cut bag, the plug can come in contact with the exterior of the bag and thus become contaminated. Another problem associated with this system is that plasma gets trapped in the corners of the bag. Whereas most of the plasma plug is removed, these trapped pockets of plasma do not drop out from the cut bag so that some loss of plasma results. Still another problem is that the bag containing the frozen plasma does not have a uniform shape which could lend itself to adaptation to an automatic bag-opening procedure. Each bag must be manually cut open. This is time-consuming and more expensive.

The conventional system is also undesirable because polyvinyl chloride (PVC) material, of which the flexible shipping containers are formed, must contain a considerable amount of plasticizers in order to give the bag its pliable, flexible characteristic. Since PVC plasticizers are leachable into the blood plasma, use of PVC may have undesirable effects on the plasma. Also, use of PVC containers precludes sterilization with a gaseous sterilizer such as ethylene oxide or formaldehyde since such gases are retained and only slowly released by PVC.

It has generally been known in the past to maintain medical equipment of various kinds in a sterile condition by placing an overwrap formed of flexible plastic around the equipment to form a protective barrier. One such approach disclosed in U.S. Pat. No. 3,468,471 issued to Linder on Sept. 23, 1969, includes the use of a plastic overwrap (bag 10) having a gas permeable bacterial filter, wherein an article placed in the overwrap, may be subjected to a gas sterilization step in which the sterilization gas is allowed to escape through the bacterial filter. A similar technique is disclosed in U.S. Pat. No. 2,204,683 wherein a container is sterilized and sealed by a cover which is in contact with the container during the sterilization process. While these conventional sterilization methods are well suited for some purposes, such methods do not satisfy the stringent requirements imposed by the need for an inexpensive method of asceptically collecting, shipping and processing blood plasma. For example, use of a flexible overwrap such as disclosed in U.S. Pat. No. 3,468,471 would not prevent contamination of the interior of a plasma shipping container unless the container were sealed at the time the overwrap is ruptured. To sterilize and seal a container before inserting the container into an overwrap for subsequent sterilization as disclosed in U.S. Pat. No. 3,468,471 would require an expensive and impractical two step sterilization method.

Also well known in the prior art are closures for rigid containers which allow air to enter the container at the same time that liquid is being withdrawn. One example of such a closure is disclosed in U.S. Pat. No. 3,746,000 which illustrates, in FIG. 1, a closure system 2 having one projection for connection with a conduit for withdrawing liquid from the container and a second projection for permitting air to enter the container. U.S. Pat. No. 2,812,117 discloses a somewhat similar closure including a filter for filtering the air entering the container. U.S. Pat. Nos. 3,480,172 and 2,314,167 are exemplary of techniques for sealing closures having a pair of passageways for both air and liquid. While the conventional closures illustrated in these patents are well suited for many purposes, the disclosed closures do not suggest solution of any of the specific problems relating to plasma processing as outlined above.

SUMMARY OF THE INVENTION

It is a primary object of this invention to overcome the drawbacks of the prior art. More particularly, the subject invention relates to a plasma receiving assembly and method of using the assembly to assure aseptic collection, shipping and processing of human blood plasma.

The more specific object of the invention is to disclose a method for forming a sterile plasma receiving assembly including the steps of placing within a flexible overwrap a rigid open container having a cover, the flexible overwrap having a gas permeable bacterial filter to form a barrier surrounding the rigid container through which bacteria may not pass, placing the rigid container and flexible overwrap within a sterilizing gas environment for a sufficient time to allow the sterilizing gas to enter and sterilize throughly the inside and outside of the rigid container and the inside of the flexible overwrap by passing through the bacterial filter and the opening in the container, removing the sterilizing gas from the interiors of the flexible overwrap and rigid container, and manipulating the cover through the flexible overwrap to sealingly secure the cover over the opening in the container, whereby the interior of the rigid container will remain sterile even if the flexible overwrap is subsequently ruptured.

Another object of this invention is to provide a method for preparing plasma for transportation to a processing center within a rigid container including the steps of opening the flexible overwrap, pulling the flexible overwrap down over the rigid container to expose the closure cap through the opening in the flexible overwrap, removing the cover from the opening of the container, introducing a volume of plasma into the rigid container, recapping the container, reforming a barrier around the rigid container by pulling the flexible overwrap back over the closure cap and sealing the opening of the flexible overwrap, and reducing the temperature of the assembly sufficiently to freeze the plasma within the rigid container, whereby plasma may be received, frozen, stored and transported in a container which is maintained in a sterile condition just prior to filling and which is protected from contamination immediately after filling by the flexible overwrap which reforms a barrier around the rigid container.

Still another object of the subject invention is to provide a method for removing frozen plasma from a rigid container including the steps of limiting the volume of plasma introduced into the container so as to leave a substantial volume of the rigid container unfilled, removing the flexible container from the flexible overwrap, raising the temperature of the container sufficiently to permit the outer surface of the frozen plasma to change to a liquid state, severing completely the rigid container circumferentially along the unfilled portion of the rigid container, and expelling the frozen plasma from the rigid container, whereby the frozen plasma need never be brought into contact with the means used for severing the rigid container.

A more general object of the subject invention is to provide a method for aseptically removing material from a presterilized rigid container including the steps of introducing the material in liquid form into the container, limiting the volume of material introduced in the container so as to leave a substantial portion of the container unfilled, lowering the temperature of the material sufficiently to cause all of the material to change to a solid state so as to permit the material to be stored and shipped, severing completely the container circumferentially along the unfilled portion of the container and expelling the frozen material from the container whereby the means used to sever the container need never be brought into contact with the material.

Still another object of the subject invention is to provide a closure cap for covering the opening of a gas sterilizable container including a cover, and base means for securing said cover to the container to hermetically seal the container opening. The base means includes liquid access means integral with the base means for permitting liquid to be introduced into the container opening and gas access means integral with said base means for permitting gas to pass into and out of the container through the container opening. The base means further includes cover retaining means for securing the cover to the base means in a fully closed position to hermetically seal the container and cover support means for providing the sole support for the cover relative to the base means when the cover is in a stable partially open position displaced from the fully closed position to form an air passage when the cover is in the partially open position for permitting gases to enter and leave the container through the gas access means.

A more specific object of the invention is to provide a closure cap having a base means wherein the base means includes a central base wall recessed inwardly with respect to a closure opening when the base means is secured to a container, and wherein a liquid access means and a gas access means are formed by outwardly directed first and second base projections integral with the central base wall. The base means further includes first and second generally cylindrical base walls connected at one end with an upstanding rim which extends beyond the outer extremities of the first and second base projections. The closure cap further comprises a cover having an outer cover wall for closing the liquid and gas access means of the base means. Integral with the outer cover wall are a pair of inwardly directed cylindrical projections for sealingly engaging the first and second base projections respectively when the cover is in the fully closed position. A cover engaging means on the base means is formed by the outer surface of the second base projection wherein the outer surface is shaped to frictionally engage one of the inwardly directed cylindrical projections of the cover to hold the cover in a partially opened position. Slot means contained in the inwardly directed cylindrical projection and in the rim of the base means form an open pathway for gas to pass into and out of the container when the cover is in the partially opened position.

Still another object of the subject invention is to provide a rigid polyethylene and/or polypropylene container for freezable liquid wherein the container includes a constant cross-sectional configuration extending over a substantial portion of the axial length of the container. The interior of the container has a regular surface such that no portion of the frozen liquid may be caught in the container. By virtue of the container's shape, frozen liquid may be expelled from the container in a single plug form by application of pressure to one end of the plug. Use of polyethylene or polypropylene or a copolymer of these two plastics with very little plasticizer eliminates the possibility of plasma contamination resulting from leached plasticizers such as now used in conventional PVC flexible bags.

Other and more specific objects of this subject invention can be discerned from the following detailed description.

DESCRIPTION OF THE PREFERRED EMBODIMENTS

Figure 1:
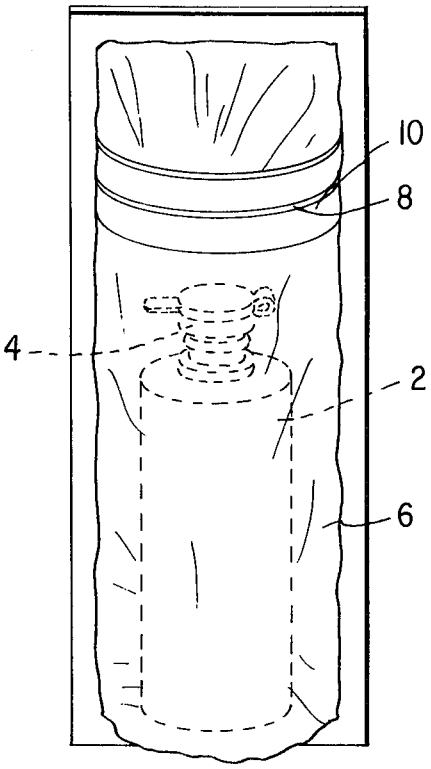
FIG. 1 is a perspective view of a plasma receiving assembly formed in accordance with the subject invention.
Figure 10:
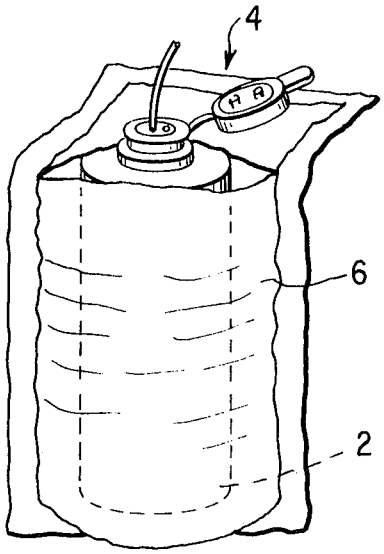
FIG. 10 is a perspective view of the plasma receiving assembly in which the overwrap has been partially opened to permit blood plasma to be inserted into the container.

FIG. 1 illustrates a plasma receiving assembly in accordance with the subject invention including a rigid or semi-rigid cylindrical container 2 preferably formed of polyethylene, polypropylene or copolymers of these two plastics. Since these materials require very little plasticizers the possibility of contamination of materials placed in containers formed of polyethylene or polypropylene is significantly reduced over containers formed of flexible PVC. The use of polyethylene or polypropylene has the further advantage of permitting gas sterilization of the container by use of ethylene oxide or formaldehyde since such sterilizing gases are not materially absorbed by polyethylene or polypropylene and cannot therefore contaminate blood plasma subsequently stored in the container. The container as shown is circular but other regularly shaped containers are equally satisfactory. The container includes an opening at one end over which is secured a closure cap 4 which will be described in much greater detail hereinbelow.

Surrounding and completely enclosing the container and closure cap is an overwrap 6 of thin sheeting, preferably polyethylene film, capable of forming a bacterial barrier around the cylindrical container 2. As illustrated in the drawings, the overwrap 6 is a rectangular flexible envelope sealed on all sides. At one end of the container an opening 8 is formed over which is secured a bacterial filter 10 having the characteristic of permitting gas flow into and out of the overwrap while preventing the passage of bacterial contaminants through the opening 8 of the overwrap. The filter 10 may be a paper tape having a porosity which allows the passage of gas but not bacteria. A cotton plug sealed in a wall or end of the overwrap will also perform this function.

The manner of operation of the plasma receiving assembly illustrated in FIG. 1 will be described in more detail below. However, for a better understanding of the operation of the disclosed assembly, the structural characteristics of the container 2 and closure cap 4 will be described before the overall operation of the assembly is outlined.

Figure 2:
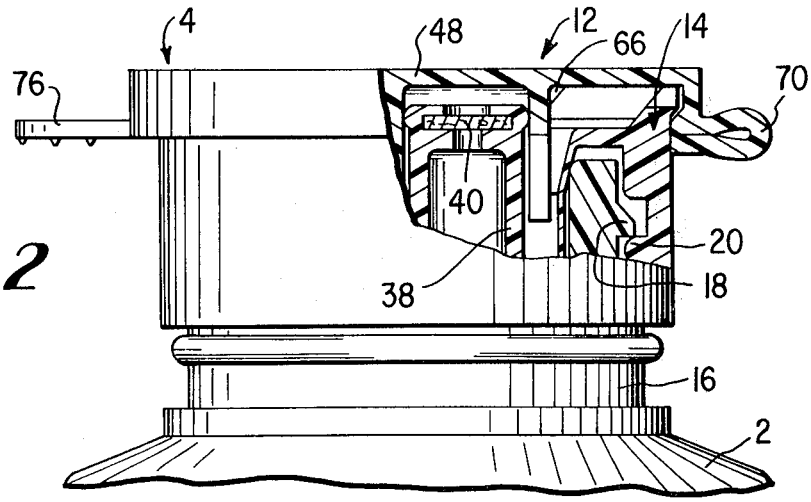
FIG. 2 is a side elevational view in partial cross-section of a closure cap for the plasma receiving assembly.

FIG. 2 illustrates in greater detail the closure cap 4 including in combination a cover 12 and base means 14 for securing the cover 12 to the container to hermetically seal the container opening. As illustrated in FIG. 2, the container includes a neck portion 16 surrounding the container opening having screw threads 18 formed on the outer periphery thereof for engagement with complementary screw threads 20 formed on base means 14. Other means for securing the base means to the container would be suitable as long as a hermetical seal is formed between the container and base means.

Figure 3:
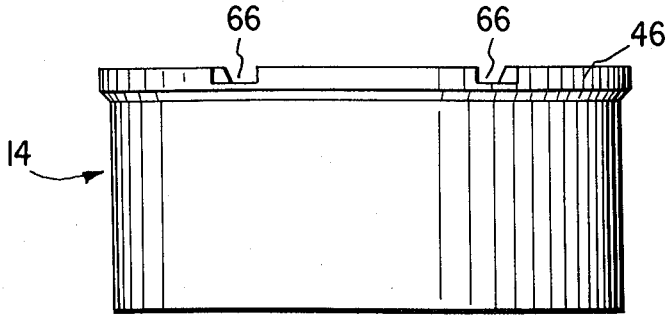
FIG. 3 is a side elevational view of the base means of the closure cap of FIG. 2.
Figure 4:
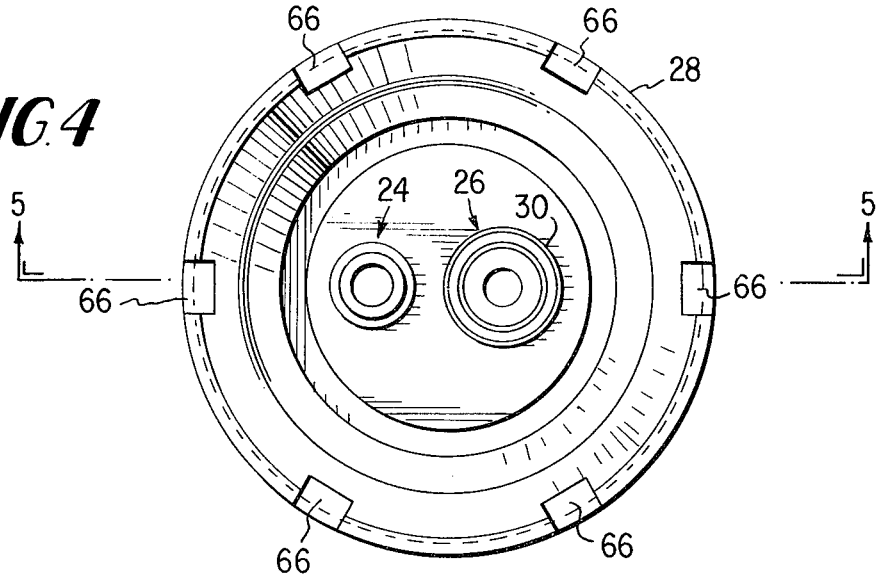
FIG. 4 is a top elevational view of the base means of FIG. 3.
Figure 5:
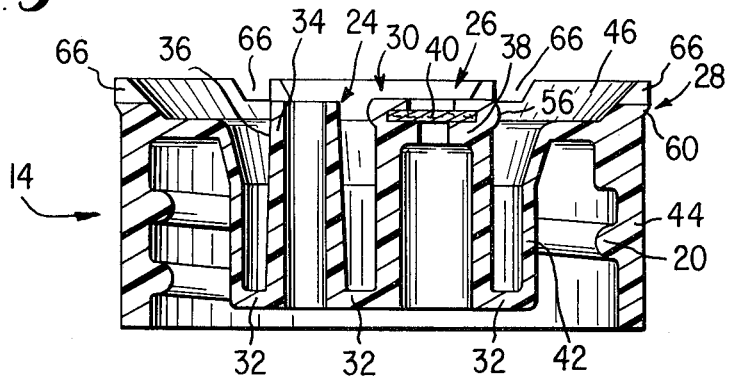
FIG. 5 is a cross-sectional view of the base means taken along lines 5—5 of FIG. 4.

Reference is now made to FIGS. 3, 4 and 5 which disclose the base means of the closure cap in greater detail. More particularly, base means 14 includes liquid access means 24 for permitting liquid to be introduced into the container through the base means and gas access means 26 for permitting gas to pass into and out of the container through the container opening. The base means 14 further includes cover retaining means 28 for securing the cover 12 to the base means in a fully closed position to hermetically seal the container and cover engaging means 30 for providing partial engagement and support of cover 12 relative to the base means when the cover is in a stable partially open position spaced from the fully closed position. In this partially open position, air passages are formed which permit gases to enter and leave the container through the gas access means.

With specific reference to FIG. 5, the base means includes a central base wall 32, recessed inwardly with respect to the container opening when the base means is secured to the container. The liquid access means 24 includes an outwardly directed first base projection 34 integral with the central base wall 32 having a male luer shaped outer surface 36 adapted for connection with a liquid conduit having a female luer shaped end whereby liquid such as blood plasma may be introduced into the container through the liquid opening means 24.

Similarly, the gas access means 26 includes an outwardly directed second base projection 38 integral with the central base wall 32. Positioned within the outwardly directed second base projection is a gas permeable bacterial filter 40 for filtering all gas entering the interior of the container thereby preventing contamination during the filling operation of the plasma assembly.

As further illustrated in FIG. 5 the base means includes a first generally cylindrical base wall 42 connected at one end with the central base wall 32 and directed outwardly in the same direction as the first and second base projections. Also, included in the base means is a second generally cylindrical base wall 44 having screw threads 20 formed on the inner surface thereof for engagement with the mating screw threads 18 formed on the neck of container 2. Connecting the other ends of the first and second generally cylindrical base walls is an upstanding rim 46 which extends beyond the outer extremities of the first and second base projections 24 and 26.

Figure 6:
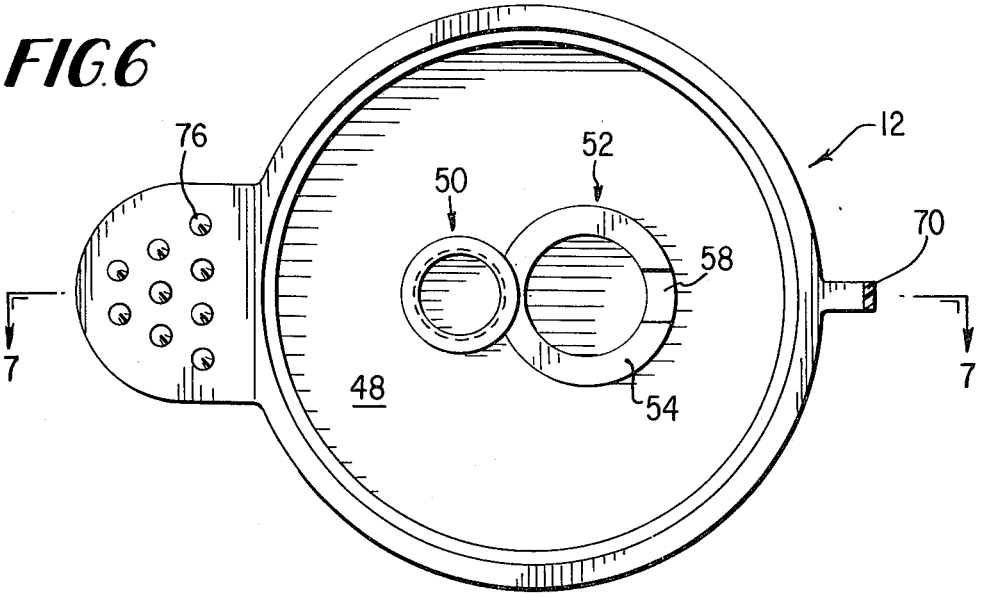
FIG. 6 is a bottom elevational view of the cover for the closure cap illustrated in FIG. 2.
Figure 7:
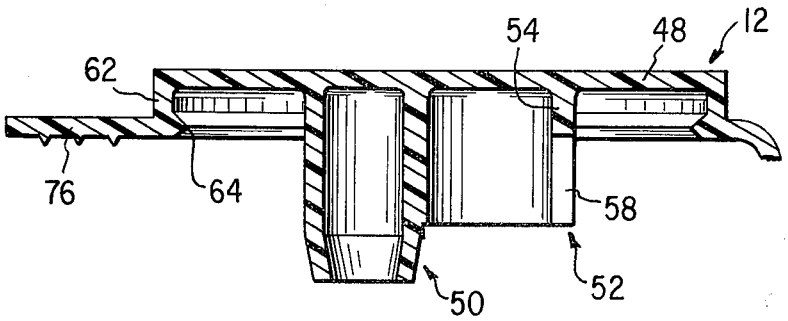
FIG. 7 is a cross-sectional view of the closure cap illustrated in FIG. 6 taken along the line 7—7.

With reference now to FIGS. 6 and 7, the cover 12 of the closure cap includes an outer cover wall 48 generally parallel with the central base wall 32 of the base means when the cover is in the fully closed position as illustrated in FIG. 2. The cover further includes an inwardly directed first sealing means 50 for sealingly engaging the first base projection 34 of the base means when the cover is in the fully closed position. Further included is a second sealing means 52 for engaging the second base projection 38 of the base means when the cover is either in the partially open or in the fully closed position.

The second sealing means 52 includes an inwardly directed cylindrical projection 54 for frictionally engaging annular bead 56 on the cover engaging means 30 formed on the outer surface of the outwardly directed second base projection 38 of the base means 14. A portion of the projection 54 of second sealing means 52 is also shared by a portion of the projection of first sealing means 50. The inwardly directed cylindrical projection 54 contains a slot 58 which forms an open pathway for gas to pass into and out of the container when the cover 12 is in the partially open position. This aspect of the operation of the closure cap is illustrated more clearly in FIG. 8 wherein the cover is disposed in the partially open position with respect to the base means 14. Note the arrows in FIG. 8 which disclose the open pathway for gas entering the container through slot 58 and gas access means 26 when the cover is in the partially open position. Comparing FIGS. 2 and 8 it is apparent that the partially opened and fully closed positions of the cover 12 are in axial alignment with one another such that application of mechanical pressure to the cover while in the partially opened position will cause the cover to be displaced into the fully closed position as illustrated in FIG. 1. Note that the second base projection 38 extends outwardly for a sufficient distance to close the slot 58 when the cover is in the fully closed position.

Figure 8:
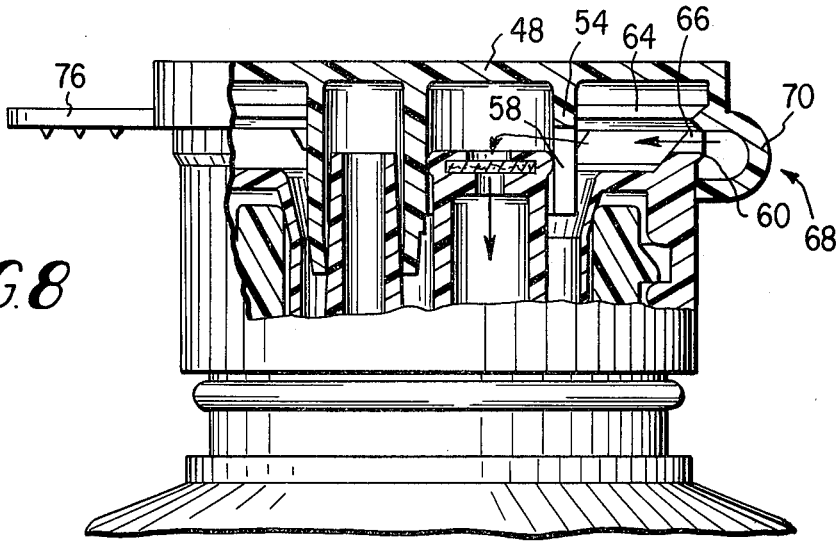
FIG. 8 is a side elevational view in partial cross-section of the closure cap wherein the cover is illustrated in the partially opened position.

As further illustrated in FIG. 8, the base means includes a radially outwardly directed bead 60 positioned adjacent the outer extremity of the upstanding rim 46 and the cover 12 includes a cylindrical cover wall 62 integral at one end with the outer cover wall 48 and extending inwardly in the same direction as the inwardly directed cylindrical projection 54. This cylindrical cover wall includes a radially inwardly directed V-shaped bead 64 along the end of the cylindrical cover wall opposite said outer cover wall 48 wherein the V-shaped bead 64 is positioned to rest on the outermost extremities of said upstanding rim 46 when the cover is in the partially opened position and to sealingly engage one surface of the radially outwardly directed bead 60 when the cover is positioned in the fully closed position.

The radially outwardly directed bead 60 has an outside diameter greater than the unstretched inside diameter of the radially inwardly directed bead 64. Thus, by forming the cover of resilient material, the radially inwardly directed bead 64 will be stretched outwardly as the cover is moved axially from the partially opened position to the fully closed position so that the bead 64 will grippingly engage the upstanding rim 46 to form a hermetic seal around the base means.

FIG. 8 also illustrates another important feature of the closure cap in which slots 66 are formed in the upstanding rim 46 to a depth sufficient to permit the passage of gas into and out of the container through the gas opening means 26 when the cover is in the partially opened position. Any number of such slots 66 may be formed in the upstanding rim, but as illustrated in FIG. 4, it is preferred to include six such slots equally spaced around the periphery of the base means. The existence of slots 66 and slot 58 in combination with the cover engaging means 30 permits sterilizing gas to circulate around into all of the spaces between the cover 12, base means 14 and into container 2 so as to sterilize all surfaces of these parts when the cover 12 is in the partially open position.

Interconnecting the cover and base means is a connecting means 68 for hingedly connecting the base means and cover including a flexible tether 70 inwardly connected at one end to the cover 12 and at the other end to the base means 14. The tether 70 extending from cover 12 need not be attached to the base means 14, but may be secured to the neck of the container as by a neck-encircling ring, for example. Disposed opposite the flexible tether 70 is a finger tab 76 adapted to facilitate manual opening of the closure cap.

Figure 9:
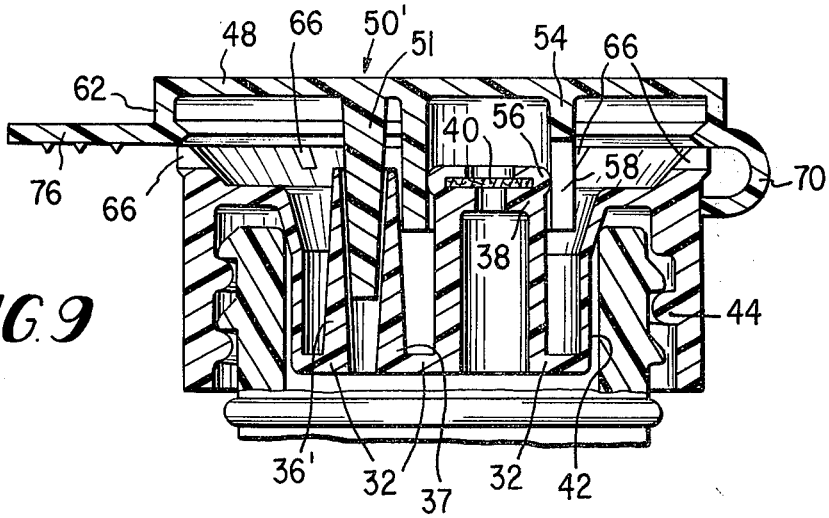
FIG. 9 is a cross-sectional view of another form of a closure cap of the present invention showing the cover in the partially opened position.

FIG. 9 illustrates an alternative embodiment of the closure cap, wherein first base projection 36' has a luer shaped (that is having a tubular truncated cone shape for cooperating with a complementary shaped connection conventionally employed in the medical field) inner surface 37 and the first sealing means 50' of the cover is a projecting tapered plug 51 adapted to fit within the first base projection 36'. Plug 51 need not be solid as illustrated but may also be a closed end hollow plug.

According to the method which forms the subject invention, a sterile plasma receiving assembly is formed from a rigid container having a closure cap including a cover such as the cap illustrated in FIGS. 2–9, the cover being manipulable to effect an open or a fully closed position. In one preferred embodiment of the method, the rigid container is placed with a closure cap in the opened position within a flexible overwrap having an opening and a gas permeable bacterial filter adapted to be secured over the flexible overwrap opening. Once the rigid container is placed within the flexible overwrap, the gas permeable bacterial filter is secured over the opening of the flexible overwrap to form a barrier surrounding the rigid container through which bacteria cannot pass. Alternatively, the bacterial filter may first be secured to an opening in the overwrap and the container with its closure cap in an open position is then inserted into the overwrap through another opening which is subsequently sealed. The rigid container and flexible overwrap is then placed within a sterilizing gas environment for a sufficient length of time to allow the sterilizing gas such as ethylene oxide or formaldehyde to enter and sterilize thoroughly all surfaces of the container, the closure cap and the inside of the flexible overwrap by passing through the bacterial filter and the open closure cap. Thereafter the sterilizing gas is removed from the interior of the flexible overwrap and the rigid container. Sufficient mechanical pressure is applied to the cover on the closure cap through the flexible overwrap to move the closure cap to the fully closed position whereby the interior of the rigid container will remain sterile even if the flexible overwrap is subsequently ruptured.

The sterile plasma receiving assembly may now be used for receiving blood plasma at a collection center by removing the filter from the flexible overwrap and pulling the flexible overwrap down over the rigid container to expose only the closure cap through the opening in the flexible overwrap. Alternatively, the top portion of the overwrap may be cut off to allow the overwrap to be pulled down to expose only the closure cap. The closure cap cover is removed and a volume of plasma is introduced into the rigid container via a suitable conduit having a connector attached to liquid access means 24 but is limited so as to leave a substantial volume of the rigid container unfilled. The introduction of blood plasma immediately follows removal of the bacterial filter or cutting off the top of the overwrap in order to minimize the chance of contamination of the exterior of the container. Once the introduction of plasma is complete, the cover is sealingly engaged and the bacterial barrier is reformed over the rigid container by pulling the flexible overwrap back over the closure cap and sealing the opening. Whereupon, the temperature of the assembly is reduced sufficiently to freeze the plasma within the rigid container, thereby the frozen plasma may be stored and transported in a container which is maintained in a sterile condition just prior to filling and which is protected from contamination immediately after filling by the flexible overwrap which reforms a barrier around the rigid container.

Once the frozen plasma still within the rigid container is received at a processing station, the rigid container is removed from the flexible overwrap and the temperature of the container is raised sufficiently to permit the outer surface of the frozen plasma to be changed to a liquid state. Because the container is rigid and of a standard uniform shape, it may be placed within completely sterile automated equipment within a bacteria free environment. The equipment is designed to circumferentially sever the container along the unfilled portion of the container by means of a cutting blade or other suitable means such as a hot wire. With the upper portion of the container removed and the outer skin of the frozen plasma in a liquid state, the plasma may be easily removed by applying pressure at one end to force the plasma out of the rigid container. The expulsion force may be created by means of a pressure conduit connected with a source of fluid pressure wherein the pressure conduit is injected into the closed end of the container thereby to force the frozen plasma out of the open end of the container by fluid pressure. By this method, plasma may be removed from a container in the frozen state by means of a method which never requires contact between the frozen plasma and the means for severing the rigid container.

Method and apparatus have been disclosed by which a rigid container may be used for the collection of plasma in an economic yet aseptic manner which overcomes the danger of contamination and the loss of valuable plasma by use of conventional flexible containers.

We claim:

1. A closure cap for covering the opening of a gas sterilizable container, comprising a. a cover; and b. base means for securing said cover to the container to seal the container opening, said base means including 1. liquid access means integral with said base means for permitting liquid to be introduced into said container through said base means,
2. gas access means integral with said base means for permitting gas to pass into and out of the container through the container opening,
3. cover retaining means for securing said cover to said base means in a fully closed position to hermetically seal the container, and
4. cover engaging means for engaging and supporting said cover in a stable partially open position relative to said base means displaced from the fully closed position, said cover engaging means forming a gas passage when said cover is in said partially open position for permitting gases to enter the container and contact all surfaces of said base means and said cover which are exposed to the interior of the container when said cover is secured to said base means in a fully closed position.

2. A closure cap as defined in claim 1, further including connecting means for hingedly connecting said base means and said cover.

3. A closure cap as defined in claim 2 wherein said cover further includes a finger tab integrally connected with said cover and positioned diametrically opposite said connecting means.

4. A container having an opening covered by a closure cap as defined by claim 1 wherein said container includes a cylindrical side wall which extends over a substantial portion of the axial length of said container, said container being formed of a gas sterilizable material.

5. A container as defined in claim 4, wherein said container is formed of polyethylene or polypropylene.

6. A closure cap as defined in claim 1 wherein said cover includes an inwardly directed projection for engaging said cover engaging means of said base means only along a small portion of the total axial extent of said inwardly directed projection.

7. A closure cap for covering the opening of a gas sterilizable container, comprising a. a cover; and b. base means for securing said cover to the container to seal the container opening, said base means including 1. liquid access means integral with said base means for permitting liquid to be introduced into said container through said base means,
2. gas access means integral with said base means for permitting gas to pass into and out of the container through the container opening,
3. cover retaining means for securing said cover to said base means in a fully closed position to hermetically seal the container, and
4. cover engaging means for engaging and supporting said cover in a stable partially open position relative to said base means displaced from the fully closed position, said cover engaging means forming a gas passage when said cover is in said partially open position for permitting gases to enter and leave the container through said gas access means, wherein said base means further includes a central base wall recessed inwardly with respect to the container opening when the base means is secured to the container, and wherein said liquid access means includes an outwardly directed first base projection integral with said central base wall, said first base projection having a configuration adaptable for connection with a liquid conduit and wherein said gas access means includes an outwardly directed second base projection integral with said central base wall.

8. A closure cap as defined in claim 7 wherein said base means further includes a first generally cylindrical base wall connected at one end with said central base wall and directed outwardly in the same direction as said first and second base projections, and a second generally cylindrical base wall concentric with said first generally cylindrical base wall, and wherein said cover retaining means includes an upstanding rim connecting said first and second generally cylindrical base walls, said upstanding rim extending beyond the outer extremities of said first and second base projections.

9. A closure cap as defined in claim 8, wherein said upstanding rim contains at least one slot positioned to provide an open gas pathway between the interior and exterior of said base means when said cover is in said partially open position.

10. A closure cap as defined in claim 8, wherein said cover includes a. an outer cover wall generally parallel with said central base wall when said cover is in the fully closed position;

b. first sealing means integral with said outer cover wall for sealingly engaging said first base projection when said cover is in the fully closed position;

c. second sealing means integral with said outer cover wall for sealingly engaging said second base projection when said cover is either in the partially open or in the fully closed position.

11. A closure cap as defined in claim 10, wherein said base means further includes a radially outwardly directed bead positioned adjacent the outer extremity of said upstanding rim and wherein said cover includes a cylindrical cover wall integral at one end with said outer cover wall and extending inwardly in the same direction as said inwardly directed cylindrical projection, said cylindrical cover wall including a radially inwardly directed bead along the end of said cylindrical cover wall opposite said outer cover wall, said inwardly directed bead being positioned to engage the outermost extremities of said upstanding rim when said cover is in said partially open position and to sealingly engage one surface of said radially outwardly directed bead when said cover is positioned in said fully closed position.

12. A closure cap as defined in claim 11, wherein the partially open and the fully closed positions of said cover are in axial alignment with one another and wherein said cover is formed of resilient material and said radially outwardly directed bead has an outside diameter greater than the unstretched inside diameter of said radially inwardly directed bead, whereby said radially inwardly directed bead is stretched outwardly as said cover is moved axially from the partially open position to the fully closed position.

13. A closure cap as defined in claim 10, wherein said second sealing means includes an inwardly directed cylindrical projection, and wherein said cover engaging means includes an outer surface formed on said second base projection for frictionally engaging said inwardly directed cylindrical projection to hold said cover in said partially open position.

14. A closure cap as defined in claim 10, wherein said inwardly directed cylindrical projection contains a slot which forms an open pathway for gas to pass into and out of the container when said cover is in said partially open position.

15. A closure cap as defined in claim 14 wherein said second base projection extends outwardly for a sufficient distance to close the slot in said inwardly directed projection when said cover is in the fully closed position.

16. A closure cap as defined in claim 13, wherein said outer surface of said second base projection includes a radially extending bead for engaging said inwardly directed cylindrical projection only along a small portion of the total axial extent of said inwardly directed cylindrical projection.

17. A closure cap as defined in claim 7, wherein said second base projection includes a gas permeable bacterial filter positioned to filter all gas entering the interior of the container.

* * * * *